US006948264B1

(12) United States Patent
Lyden

(10) Patent No.: US 6,948,264 B1
(45) Date of Patent: Sep. 27, 2005

(54) NON-CLOGGING SOLE FOR ARTICLE OF FOOTWEAR

(76) Inventor: Robert M. Lyden, 18261 SW. Fallatin Loop, Aloha, OR (US) 97707

( * ) Notice: Subject to any disclaimer, the term of this patent is extended or adjusted under 35 U.S.C. 154(b) by 161 days.

(21) Appl. No.: 10/059,882

(22) Filed: Jan. 29, 2002

Related U.S. Application Data

(63) Continuation-in-part of application No. 09/559,124, filed on Apr. 26, 2000, now abandoned.

(51) Int. Cl.[7] ..... A43B 11/00; A43B 23/28

(52) U.S. Cl. ..... 36/59 C; 36/134; 36/67 R; 36/59 R; D2/951

(58) Field of Search ..... 36/134, 67 R, 36/59 R, 59 C; D2/951, 952, 954, 955

(56) References Cited

U.S. PATENT DOCUMENTS

| | | | | |
|---|---|---|---|---|
| 400,867 A | | 4/1889 | Meyers | 36/59 R |
| 1,568,064 A | | 1/1926 | Goldman | |
| 1,768,426 A | | 6/1930 | Stelzer | |
| D90,450 S | | 8/1933 | Oakley | |
| 2,258,734 A | | 10/1941 | Brady | 36/59 |
| 2,303,744 A | | 12/1942 | Jacobs | 36/29 |
| 2,844,833 A | | 7/1958 | Odermatt | 12/146 |
| D196,486 S | * | 10/1963 | Papoutsy | D2/954 |
| D201,952 S | | 8/1965 | Johns | D7/5 |
| 3,341,952 A | | 9/1967 | Dassler | 36/2.5 |
| 3,352,034 A | | 11/1967 | Braun | 36/67 |
| 3,410,005 A | | 11/1968 | Szernyi | 36/2.5 |
| 3,552,040 A | | 1/1971 | Welco et al. | 36/30 |
| 3,553,858 A | | 1/1971 | Austin | 36/67 |
| 3,555,697 A | | 1/1971 | Dassler | 36/2.5 |
| 3,577,663 A | | 5/1971 | Mershon | 36/67 |
| 3,597,863 A | | 8/1971 | Austin | 36/59 |
| 3,672,077 A | | 6/1972 | Coles | 36/2.5 |
| 3,760,514 A | | 9/1973 | Egtvedt | 36/67 R |
| 3,816,945 A | | 6/1974 | Egtvedt | 36/2.5 AE |
| 3,846,921 A | | 11/1974 | Kobayashi | 36/59 R |
| 3,888,026 A | | 6/1975 | Dassler | 36/25 R |
| 3,928,881 A | | 12/1975 | Bente | 12/142 R |
| 3,993,371 A | | 11/1976 | Orndorff, Jr. | 308/238 |
| 4,007,549 A | | 2/1977 | Moore | 36/59 C |
| 4,085,526 A | | 4/1978 | Hemmer | 36/59 R |
| 4,107,858 A | | 8/1978 | Bowerman et al. | 36/134 |
| 4,130,947 A | | 12/1978 | Denu | 36/30 A |
| 4,160,331 A | | 7/1979 | Bell | 36/59 B |
| 4,178,702 A | | 12/1979 | Mayer | 36/59 R |
| 4,194,310 A | | 3/1980 | Bowerman | 36/128 |

(Continued)

FOREIGN PATENT DOCUMENTS

| | | | |
|---|---|---|---|
| GB | 2 256 784 A | 12/1992 | A43B 13/00 |

(Continued)

*Primary Examiner*—Jila M. Mohandesi
(74) *Attorney, Agent, or Firm*—Westman Champlin & Kelly, P.A.

(57) ABSTRACT

The present invention teaches an article of footwear having a non-clogging for use on natural grass and also artificial turf surfaces. A preferred sole can include protrusions comprising a hydrophobic material having a wettability index equal to or greater than 90 degrees. The sole can include protrusions having a width at the tip in the range between 2–4 mm, a height in the range between 3–6 mm, and the closest portion of adjacent protrusions can be spaced at least 3 mm apart. In particular, the closest portion of adjacent protrusions can be spaced in the range between 3–6 mm. An alternate sole can include protrusions and traction members comprising a hydrophobic material. The present invention also teaches novel detachable cleats for use with an article of footwear.

16 Claims, 9 Drawing Sheets

U.S. PATENT DOCUMENTS

| | | | | | |
|---|---|---|---|---|---|
| 4,223,459 | A | | 9/1980 | Riggs | 36/114 |
| 4,233,759 | A | | 11/1980 | Bente et al. | 36/59 R |
| 4,240,215 | A | | 12/1980 | Broussard | 36/67 D |
| 4,266,349 | A | | 5/1981 | Schmohl | 36/32 R |
| 4,287,307 | A | | 9/1981 | Hostettler | 521/51 |
| 4,299,038 | A | | 11/1981 | Epple | 36/67 D |
| 4,318,232 | A | | 3/1982 | Ching | 36/73 |
| 4,327,503 | A | | 5/1982 | Johnson | 36/32 R |
| 4,344,999 | A | | 8/1982 | Gohlke | 428/212 |
| 4,347,674 | A | | 9/1982 | George | 36/126 |
| 4,348,003 | A | | 9/1982 | Beneteau | 249/96 |
| 4,356,643 | A | | 11/1982 | Kester et al. | 36/59 C |
| 4,357,763 | A | | 11/1982 | Fleischmann et al. | 36/67 D |
| 4,366,632 | A | | 1/1983 | Bente | 36/67 D |
| 4,392,312 | A | | 7/1983 | Crowley et al. | 36/67 R |
| 4,393,604 | A | | 7/1983 | Crowley | 36/67 R |
| 4,398,357 | A | | 8/1983 | Batra | 36/30 A |
| 4,402,145 | A | | 9/1983 | Dassler | 36/32 R |
| 4,414,763 | A | | 11/1983 | Bente | 36/134 |
| 4,434,518 | A | * | 3/1984 | Watanabe | 12/142 BRS |
| 4,445,289 | A | | 5/1984 | Beneteau | 36/134 |
| 4,454,662 | A | | 6/1984 | Stubblefield | 36/91 |
| D275,147 | S | * | 8/1984 | Phillpott | D2/954 |
| 4,470,207 | A | | 9/1984 | Bente | 36/134 |
| 4,481,333 | A | | 11/1984 | Fleischer et al. | 525/192 |
| 4,494,320 | A | | 1/1985 | Davis | 36/25 R |
| D278,382 | S | * | 4/1985 | Chen | D2/955 |
| 4,523,396 | A | | 6/1985 | Dassler | 36/134 |
| 4,547,979 | A | | 10/1985 | Harada et al. | 36/30 R |
| 4,559,366 | A | | 12/1985 | Hostettler | 521/51 |
| 4,559,724 | A | | 12/1985 | Norton | 36/129 |
| 4,561,197 | A | | 12/1985 | Misevich | 36/127 |
| 4,562,651 | A | | 1/1986 | Frederick et al. | 36/102 |
| 4,564,966 | A | | 1/1986 | Chen | 12/146 B |
| 4,578,883 | A | | 4/1986 | Dassler | 36/116 |
| 4,586,274 | A | | 5/1986 | Blair | 36/59 R |
| 4,596,839 | A | | 6/1986 | Peters | 523/175 |
| 4,599,810 | A | | 7/1986 | Sacre | 36/55 |
| 4,633,600 | A | | 1/1987 | Dassler et al. | 36/134 |
| 4,644,672 | A | | 2/1987 | Dassler et al. | 36/134 |
| 4,648,187 | A | | 3/1987 | Dassler et al. | 36/134 |
| 4,653,206 | A | | 3/1987 | Tanel | 36/126 |
| 4,660,304 | A | | 4/1987 | Tanel | 36/126 |
| 4,667,425 | A | | 5/1987 | Effler et al. | 36/126 |
| 4,669,204 | A | | 6/1987 | Tanel | 36/126 |
| 4,670,997 | A | | 6/1987 | Beckman | 36/114 |
| D290,781 | S | * | 7/1987 | Grubel | D2/955 |
| 4,689,901 | A | | 9/1987 | Ihlenburg | 36/126 |
| 4,698,924 | A | | 10/1987 | Greiner et al. | 36/134 |
| 4,712,318 | A | | 12/1987 | Greiner et al. | 36/134 |
| 4,723,365 | A | | 2/1988 | Tanel | 36/126 |
| 4,741,114 | A | | 5/1988 | Stubblefield | 36/32 R |
| 4,747,220 | A | | 5/1988 | Autry et al. | 36/59 R |
| 4,748,750 | A | | 6/1988 | George | 36/59 R |
| 4,748,752 | A | | 6/1988 | Tanel | 36/126 |
| 4,782,604 | A | | 11/1988 | Wen-Shown | 36/127 |
| 4,809,447 | A | | 3/1989 | Pacanowsky et al. | 36/9 R |
| 4,833,796 | A | | 5/1989 | Flemming | 36/134 |
| RE33,066 | E | | 9/1989 | Stubblefield | 36/83 |
| 4,897,936 | A | | 2/1990 | Fuerst | 36/30 A |
| 4,899,465 | A | | 2/1990 | Bleimhofer et al. | 36/14 |
| 4,962,136 | A | | 10/1990 | Peters | 523/220 |
| 5,036,606 | A | | 8/1991 | Erich et al. | 36/134 |
| 5,058,292 | A | | 10/1991 | Tanel | 36/126 |
| 5,065,534 | A | | 11/1991 | Collins | 36/134 |
| 5,077,916 | A | | 1/1992 | Beneteau | 36/114 |
| 5,143,963 | A | | 9/1992 | Sterling et al. | 524/366 |
| 5,197,210 | A | | 3/1993 | Sink | 36/127 |
| 5,243,775 | A | | 9/1993 | Swain | 36/134 |
| 5,286,279 | A | | 2/1994 | Wu | 95/45 |
| 5,286,773 | A | | 2/1994 | Sterling et al. | 524/366 |
| 5,313,718 | A | | 5/1994 | McMahon et al. | 36/59 C |
| 5,335,429 | A | | 8/1994 | Hansen | 36/7.5 |
| 5,351,421 | A | | 10/1994 | Miers | 36/128 |
| 5,461,801 | A | | 10/1995 | Anderton | 36/114 |
| 5,628,129 | A | | 5/1997 | Kilgore et al. | 36/134 |
| 5,632,057 | A | | 5/1997 | Lyden | 12/146 B |
| 5,643,516 | A | | 7/1997 | Raza et al. | 264/127 |
| 5,663,127 | A | | 9/1997 | Flynn et al. | 508/250 |
| D387,892 | S | | 12/1997 | Briant | D2/962 |
| 5,700,843 | A | | 12/1997 | Valoppi | 521/51 |
| D389,298 | S | | 1/1998 | Briant | D2/962 |
| 5,704,137 | A | | 1/1998 | Dean et al. | 36/28 |
| 5,709,954 | A | * | 1/1998 | Lyden et al. | 428/500 |
| 5,743,029 | A | * | 4/1998 | Walker et al. | 36/134 |
| D395,540 | S | * | 6/1998 | Gaudio | D2/954 |
| 5,761,833 | A | | 6/1998 | McMullin | 36/67 D |
| D396,549 | S | | 8/1998 | von Conta et al. | D2/955 |
| 5,832,636 | A | | 11/1998 | Lyden et al. | 36/59 R |
| 5,864,968 | A | | 2/1999 | Mann | 36/29 |
| 5,873,184 | A | | 2/1999 | Ihlenburg | 36/67 R |
| 6,016,613 | A | | 1/2000 | Campbell et al. | 36/59 C |
| 6,018,889 | A | | 2/2000 | Friton | 36/28 |
| 6,076,283 | A | * | 6/2000 | Boie | 36/59 C |
| D428,241 | S | * | 7/2000 | Ferrer | D2/952 |
| 6,342,544 | B1 | | 1/2002 | Krstic et al. | 523/167 |
| 6,367,167 | B1 | | 4/2002 | Krstic et al. | 36/25 R |

FOREIGN PATENT DOCUMENTS

| | | | |
|---|---|---|---|
| GB | 2 257 616 A | 1/1993 | A43C 15/16 |
| WO | WO 99/22615 | 5/1999 | A43B 23/28 |

* cited by examiner

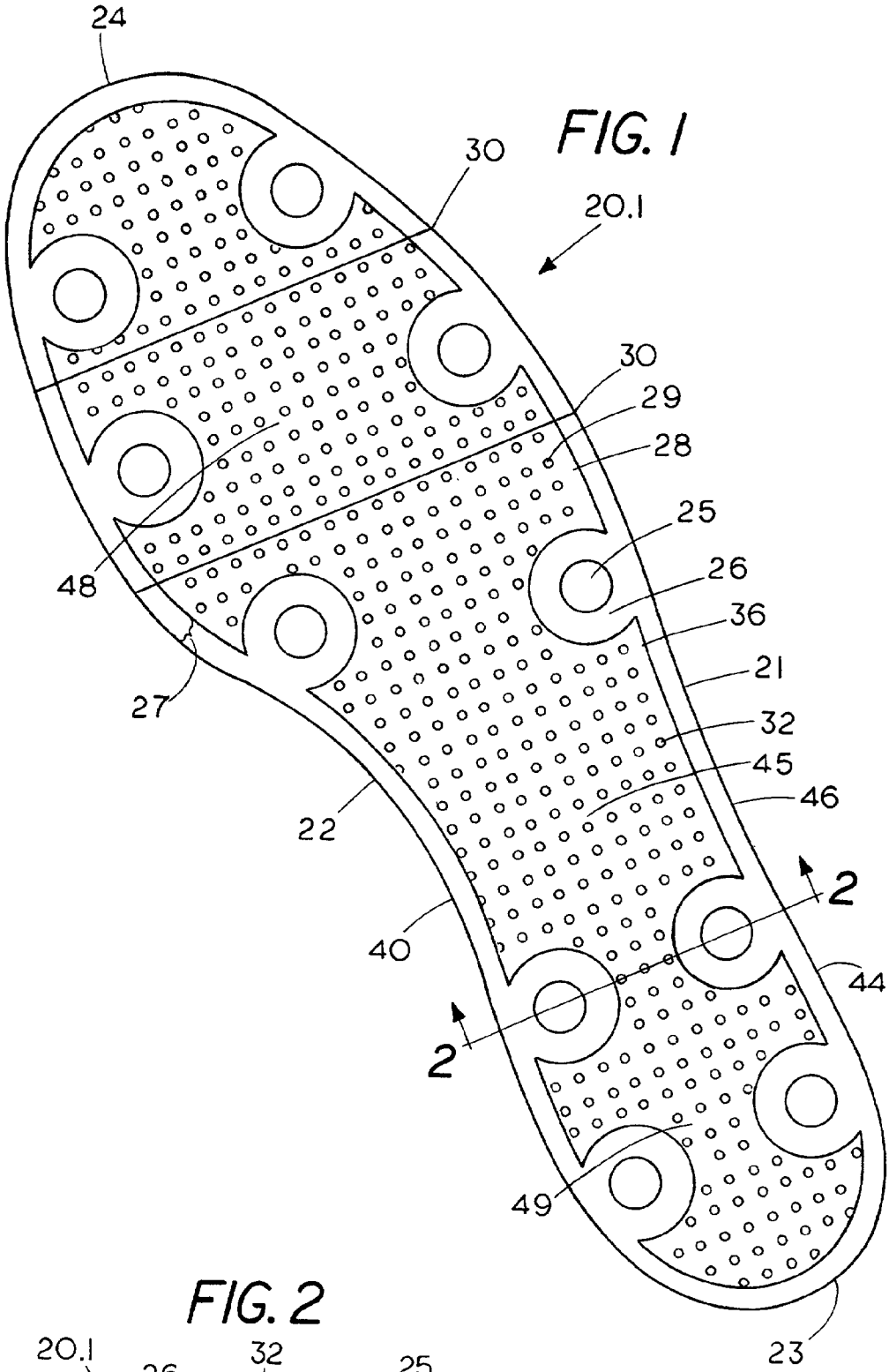
FIG. 1
FIG. 2
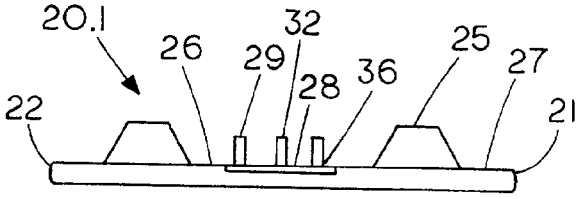

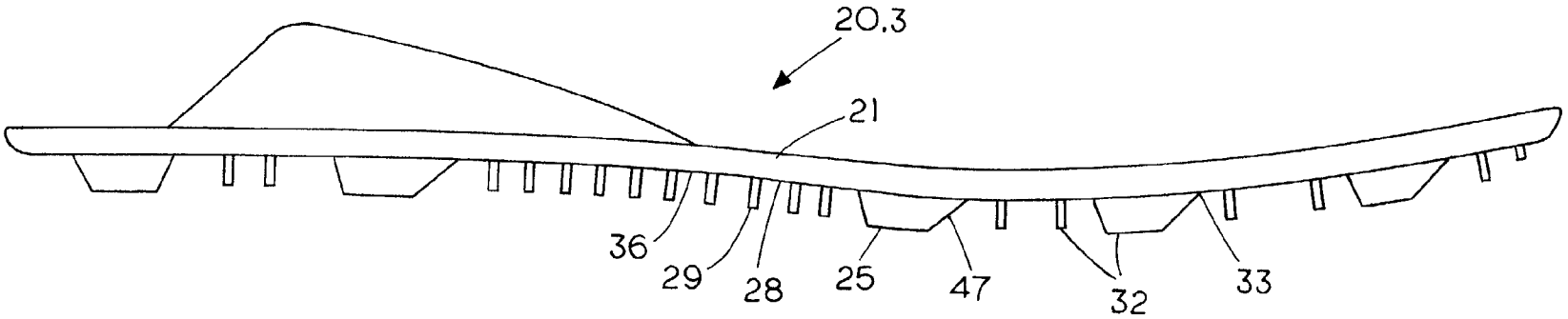
FIG. 5.1
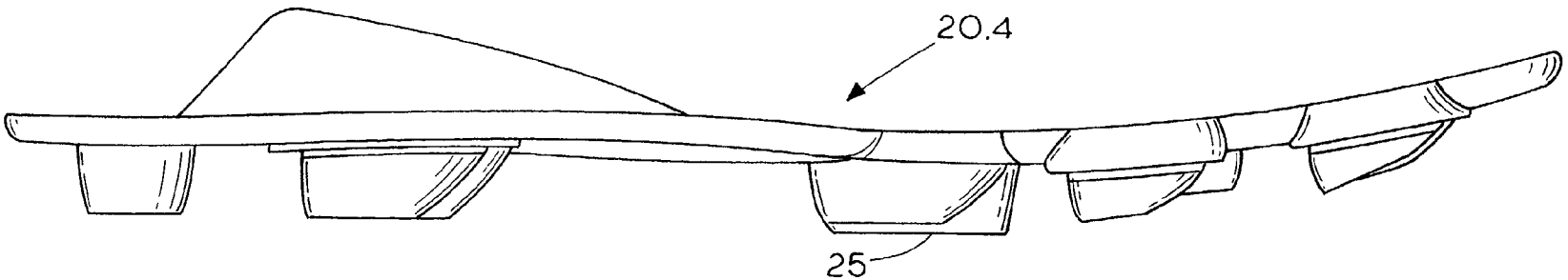
FIG. 5.2
PRIOR ART

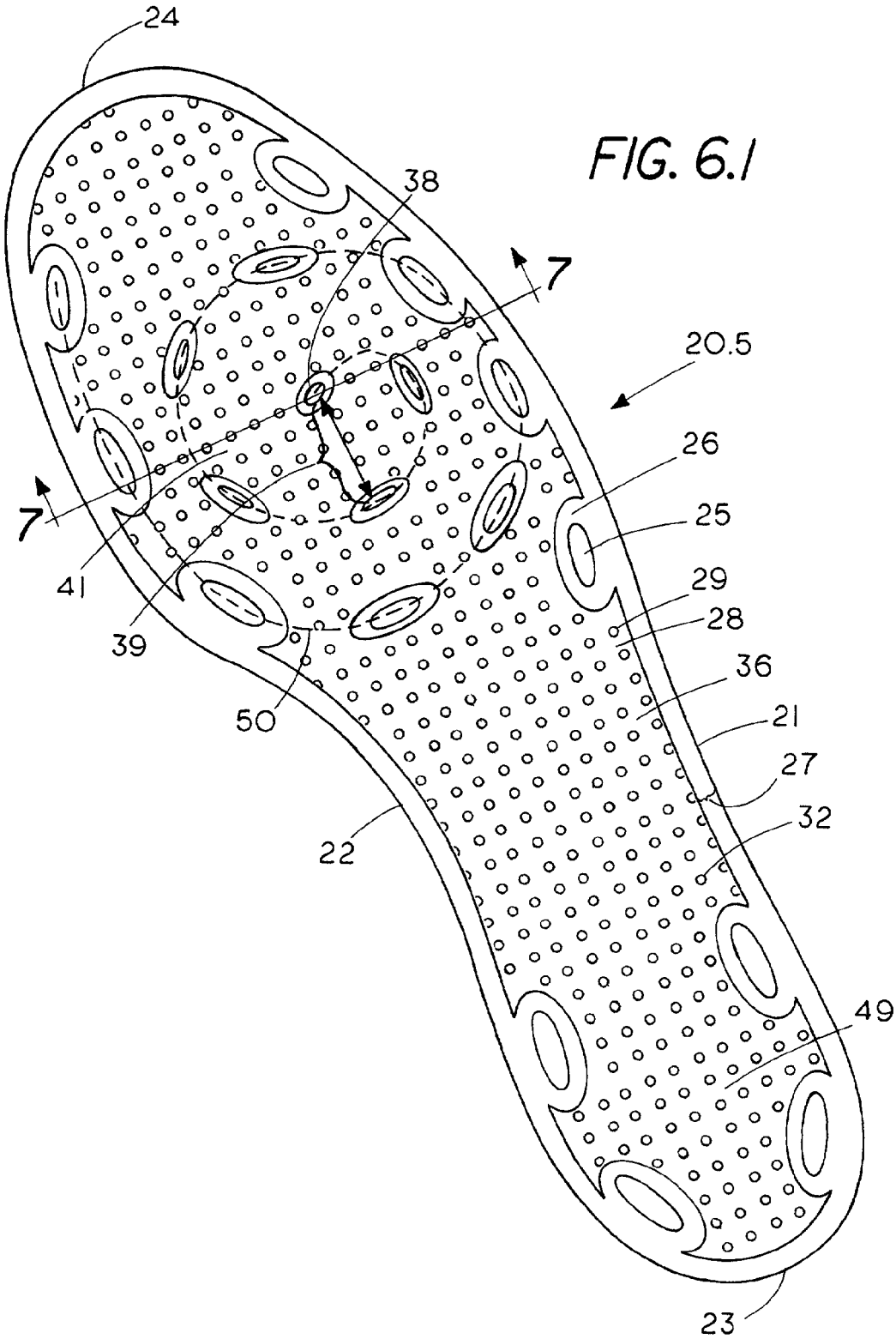
FIG. 6.1

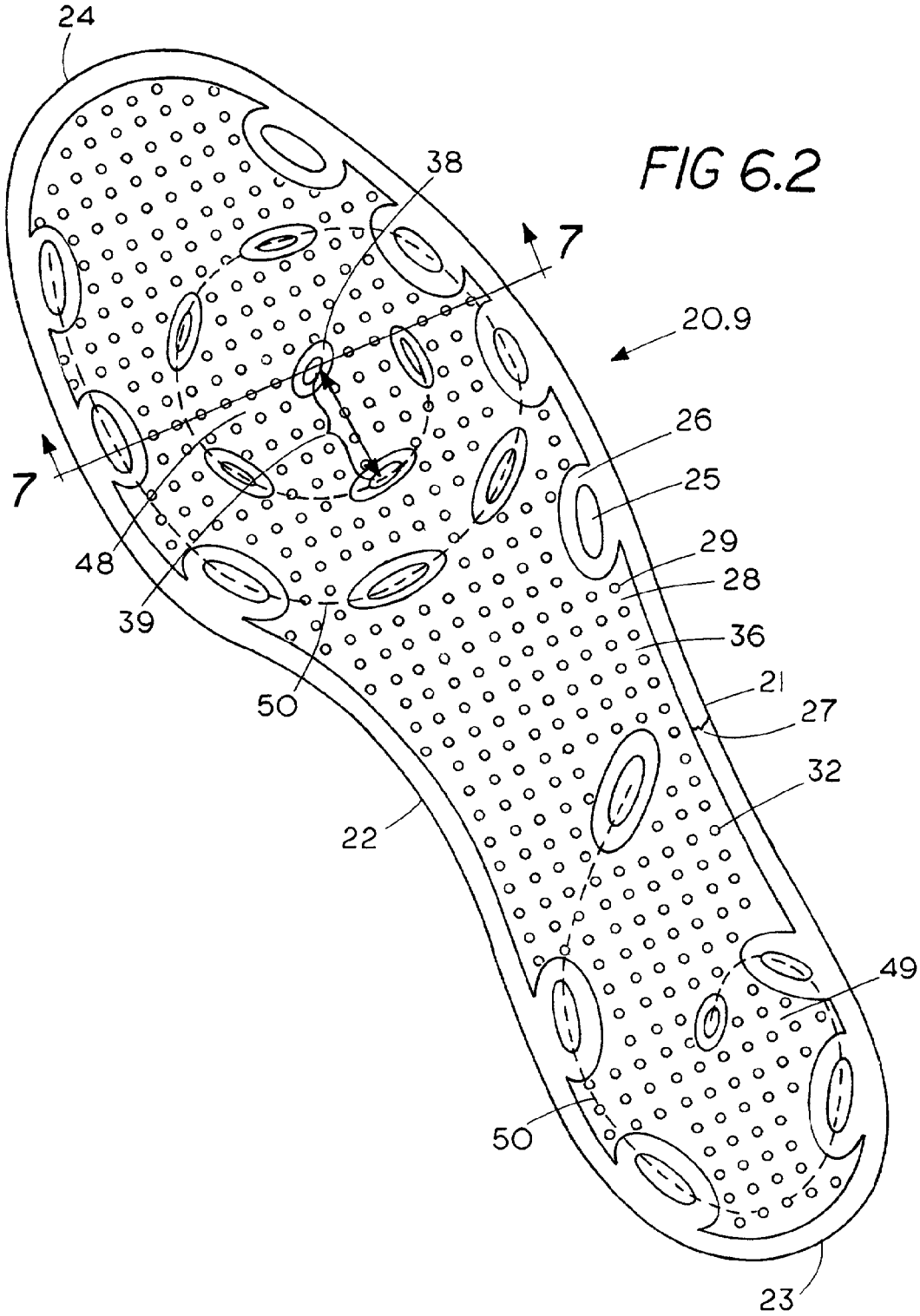
FIG 6.2

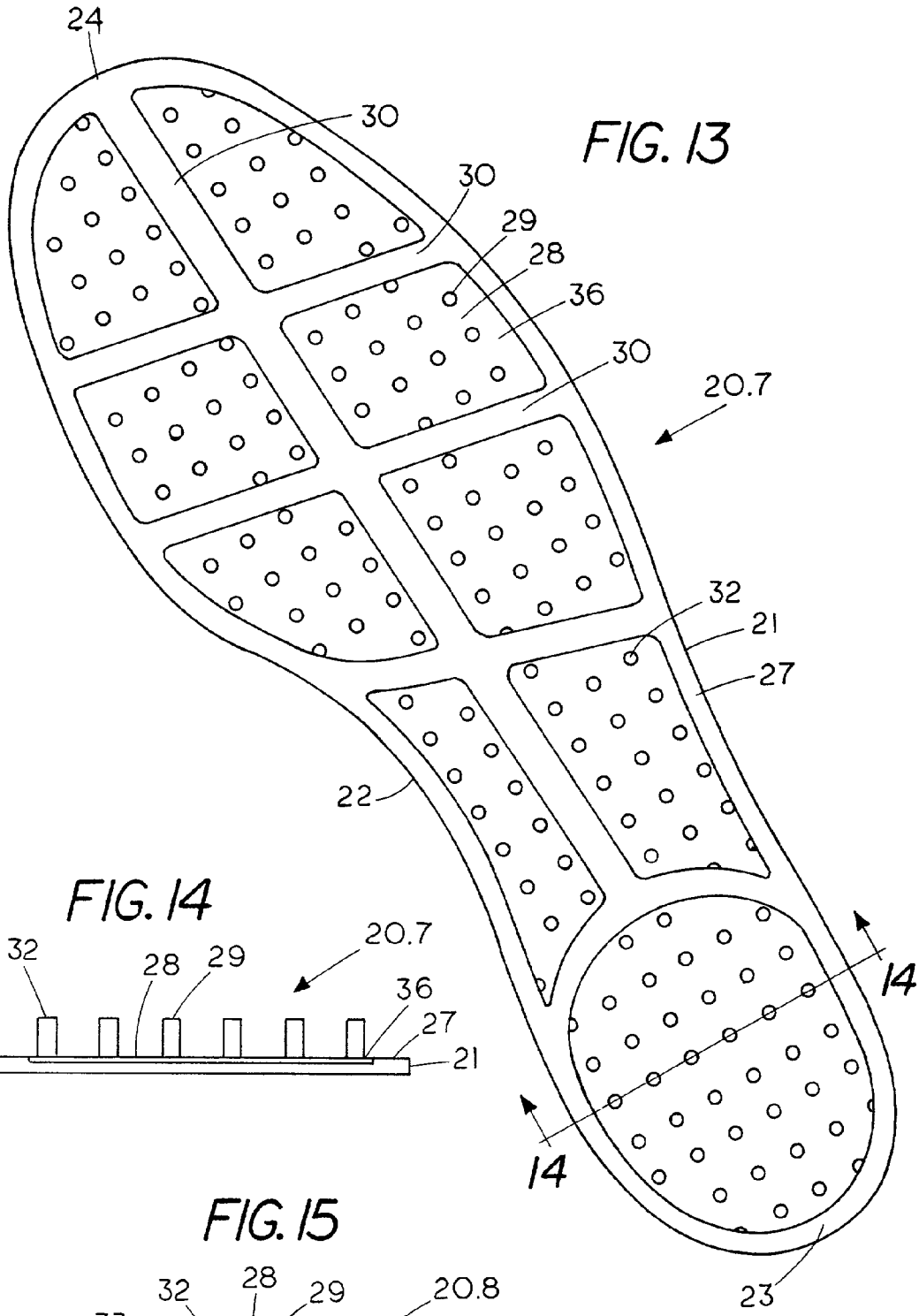
FIG. 13
FIG. 14
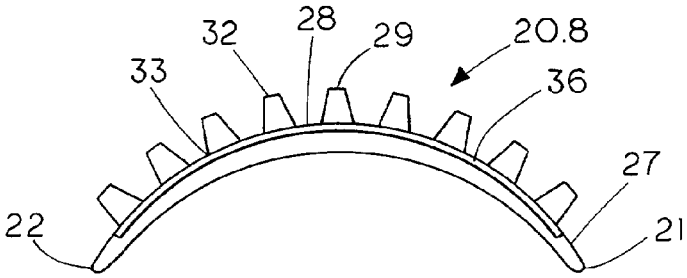
FIG. 15

NON-CLOGGING SOLE FOR ARTICLE OF FOOTWEAR

CROSS-REFERENCE TO RELATED APPLICATION

The present application is a Continuation-In-Part of patent application Ser. No. 09/559,124 filed on Apr. 26, 2000 now abandoned, and entitled "Non-Clogging Sole For Article of Footwear." Reference is also made to U.S. Pat. No. 5,832,636 entitled "Article of Footwear Having Non-Clogging Sole," taught by the present inventor and Souheng Wu, and assigned to Nike, Inc., which issued on Nov. 10, 1998.

BACKGROUND OF THE INVENTION

The present invention teaches novel non-clogging soles for articles of footwear. U.S. Pat. No. 5,832,636 entitled "Article of Footwear Having Non-Clogging Sole," taught by the present inventor and Souheng Wu, and assigned to Nike, Inc., which issued on Nov. 10, 1998, is hereby incorporated by reference herein. The information contained in U.S. Pat. No. 5,832,636 is referenced and relied upon, and it may be advantageous for the reader to review FIGS. 14–20, Tables I–V, and the interfacial theory of adhesion and release disclosed at Column 13, Line 64 and continuing through Column 24, line 67.

The present invention teaches novel non-clogging soles for article of footwear including an adhesion prevention material having low wettability characterized such that the average of the advancing and receding contact angles of a drop of pure distilled water on the adhesion prevention material, hereinafter called the wettability index, is equal to or greater than 90 degrees.

It is known in the prior art to use a material having low surface energy on the sole of an article of footwear, that is, water contact angle measurements performed on these materials exhibit yield a wettability index of equal to or greater than 90 degrees. Such materials are generally considered to be hydrophobic and do not have an affinity with respect to water. The presence of water in the foreign matter encountered on natural or synthetic surfaces is a major contributing factor with respect to adhesion and clogging of the soles of articles of footwear.

U.S. Pat. No. 3,552,040 to L. B. Welco et al. entitled "Bowling Shoe" teaches a bowling shoe having a sole including a fluorocarbon material such as TEFLON®.

U.S. Pat. No. 3,888,026 to Adolf Dassler entitled "Running Sole For Sports Shoe" teaches a sole made of a natural or synthetic textile material such as polyester which is coated with a synthetic resin or epoxy. A plurality of fiber bristles are taught which can have a height of 1.5–3 mm and row spacing of 3 mm.

U.S. Pat. No. 4,240,215 to Mayo Broussard entitled "Shoe Spike" teaches a shoe spike including a stationary non-wetting member or movable washer made of polyethylene or TEFLON® material.

U.S. Pat. No. 4,578,883 to Armin Dassler entitled "Pair of Shoes For The Sport Of Curling" teaches the use of protruding inserts having convex outer surfaces which can be made of TEFLON® fluoropolymer.

U.S. Pat. No. 4,833,796 to Udo Flemming entitled "Gripping Element for Sport Shoes and Soles Utilizing the Same," teaches a sole having gripping elements including an insert having a tread portion which can be made of a hard ceramic or metal material and a base portion which can be made of polyethylene, and alternately, also a detachable gripping element having similar structure.

U.S. Pat. No. 5,313,718 to Thomas McMahon and Gordon Valiant entitled "Athletic Shoe With Bendable Traction Projections" teaches the use of materials having a low coefficient of friction such as TEFLON® fluoropolymer or polyethylene in concentric rings and bendable traction projections on the sole of an athletic shoe.

German Patent DE 41 38941 A1 to Winfried Heinzel teaches studs or spikes for a shoe having a metal body including an anti-stick coating made of fluoroethylene.

U.S. Pat. No. 5,761,833 to Faris McMullin entitled "Athletic Shoe Traction System For Use on Turf" teaches a shoe traction system which uses a plurality of miniature spikes, and this patent is hereby incorporated by reference herein.

U.S. Pat. No. 5,873,184 to Frederick Ihlenburg entitled "Cleated Athletic Shoe Sole For Traction And Stability" teaches a sole for a sport shoe to provide increased traction and stability, and this patent is hereby incorporated by reference herein.

PCT Patent WO 99/22615 by Derek Campbell and Peter Backus entitled "Golf Shoe Outsole With Pivot Control Traction Elements" teaches a golf shoe having a plurality of first and second traction projections extending out from the outsole to define a ground engaging portion, and this patent is hereby incorporated by reference herein.

The United States Army had developed a clog resistant sole for use in tropical conditions known as the "Panama Sole" in the early 1960's which is still in service today. A vulcanized rubber compound was developed including ethylene which conveyed clog resistant characteristics to the sole. Information on the development of the "Panama Sole" can be obtained from the Natic Research Laboratory in Natic, Mass. and the Office of the Quartermaster General. Present manufacturers of the "Panama Sole" include Altama Delta, Inc. located in Atlanta, Ga., and Ro-Search associated with the Welco, Corporation located in Wainsville, Tenn.

It would be prudent to consult with a competent patent attorney in order to avoid possible infringement of recent patents which are still in force including: U.S. Pat. No. 5,832,636 granted to the present inventor and Souheng Wu, and U.S. Pat. No. 5,313,718 granted to Thomas McMahon and Gordon Valiant assigned to Nike, Inc.; or U.S. Pat. No. 4,833,796 granted to Udo Flemming, and U.S. Pat. No. 4,578,883 granted to Armin Dassler assigned to Puma AG Rudolf Dassler Sport; or German DE 41 38941 A1 granted to Winfried Heinzel. Prior art teachings which are now in the public domain include U.S. Pat. No. 3,552,040 to L. B. Welco et al., U.S. Pat. No. 4,240,215 to Mayo Broussard, and the aforementioned "Panama Sole" developed for U.S. military forces during the 1960's that is still in service.

Other prior art patents which teach athletic shoes having cleats or traction members include:

U.S. Pat. No. 3,555,697 to Rudolf Dassler teaches the use of bristles on the sole of an athletic shoe.

U.S. Pat. No. 4,347,674 to Gary George entitled "Athletic Shoe" teaches a plurality of traction members arranged at two concentric radii.

U.S. Pat. No. 4,356,643 to A. Kester and George Spector entitled "Non-Slip Footwear" teaches the use of nylon fibers on the sole of an article of footwear.

U.S. Pat. No. 4,402,145 to Armin Dassler entitled "Tread Sole For Athletic Shoe Consisting of Rubber or Another Material Having Rubber-Elastic Properties" teaches a plurality of traction members.

U.S. Pat. No. 4,564,966 to York Chen entitled "Construction For An Athletic Shoe And Process of Making," teaches molded studs and areas of enhanced wear resistance.

U.S. Pat. No. 4,670,997 to Stanley Beekman entitled "Athletic Shoe Sole" teaches flexible members and an axis of rotation.

U.S. Pat. No. 4,689,901 to Frederick Ihlenburg entitled "Reduced Torsion Resistance Athletic Shoe Sole" teaches concentric traction arrays.

U.S. Pat. No. 4,747,220 to James Autry et al., entitled "Cleated Sole For Activewear Shoe" teaches a light weight outsole having more durable cleats disposed at strategic points therein.

U.S. Pat. No. 4,748,750 to Gary George teaches tapered cleats.

U.S. Pat. Nos. 5,058,292, 4,748,752, 4,723,365, 4,669,204, 4,653,206,4,660,304, to Michael Tanel teach pivoting athletic soles.

U.S. Pat. No. 5,351,421 to David Miers entitled "Sports Shoe Sole" blade-like traction projections.

U.S. Design Pat. Nos. 387,892 and 389,298 to Antoine Briant entitled "Cleated Shoe Sole" teaches a sole for a soccer shoe.

It is an object of the present invention to provide a substantially non-clogging sole for articles of footwear.

It is an object of the present invention to provide a substantially non-clogging sole for soccer shoes, biking boots or shoes, sandals for outdoor use, and military boots.

It is an object of the present invention to provide a substantially non-clogging sole which exhibits a wettability index of greater than 85 degrees, and preferably equal to or greater than 90 degrees.

It is an object of the present invention to provide substantially non-clogging detachable cleats for use with articles of footwear.

It is an object of the present invention to make an article of footwear for use on natural or synthetic surfaces having traction members, lugs, or cleats characterized by relatively low height, thereby enhancing stability and reducing the risk of possible injury due to inversion or eversion of the foot.

It is an object of the present invention to make an article of footwear for use on natural or synthetic surfaces having traction members, lugs, or cleats characterized by relatively low height, thereby reducing the risk of injury due to foot fixation.

It is an object of the present invention to make an article of footwear for use on natural or synthetic surfaces having traction members, lugs, or cleats characterized by relatively low height, thereby improving the overall performance afforded by the article of footwear such as the wearer's ability to execute cutting and lateral movements.

It is an object of the present invention to make an article of footwear for use on natural or synthetic surfaces having traction members, lugs, or cleats characterized by relatively low height, thereby avoid the introduction of high local plantar pressure and enhance the wearer's perception of comfort and cushioning.

It is an object of the present invention to enhance the traction afforded by the sole of an article of footwear on a natural or synthetic surface.

It is an object of the present invention to enhance the cleanliness of the soles of articles of footwear.

It is an object of the present invention to make an article of footwear for use on natural or synthetic surfaces having traction members, lugs, or cleats characterized by relatively low height, thereby lessening wear and damage to the ground support surface.

SUMMARY OF THE INVENTION

The preferred sole for an article of footwear can have an anterior side, posterior side, medial side, and lateral side, and includes a ground engaging surface having protrusions. The sole can be made of a textile material, a thermoplastic material, a thermoset rubber material, or a hybrid thermoplastic elastomer, whether in partial or complete combination. The preferred sole includes a hydrophobic material having a wettability index equal to or greater than 90 degrees.

The protrusions can have an annular, elliptical, conical, semi-conical, or blade-like configuration, or can be configured in other more complex shapes. The protrusions preferably have a width at the tip in the range between 2–4 mm, a height in the range between 3–6 mm, and the closest portion of adjacent protrusions are spaced at least 3 mm apart. Further, the closest portion of the adjacent protrusions can be spaced apart in the range between 3–10 mm, and in particular, in the range between 3–6 mm. Accordingly, the protrusions can have a width of 2 mm, a height of 4 mm, and the closest portion of adjacent protrusions can be spaced 4 mm apart.

The protrusions can be made of fiber bristles which consist of a hydrophobic material. Alternately, the fiber bristles can be made of a hydrophilic material and can be coated with a hydrophobic material.

A preferred sole can include a periphery and a central region. The central region can include a hydrophobic material having a wettability index equal to or greater than 90 degrees, and the periphery can include a hydrophilic material having a wettability index less than 90 degrees. The periphery can extend in the range between 4–10 mm from the perimeter of the sole. The periphery can be made of a material which is softer on a Shore Durometer scale than the material used in the central region.

A preferred sole can further include a plurality of traction members. The traction members can have a greater height than the protrusions. The traction members can be softer on a Shore Durometer scale than the protrusions. The traction members can include a hydrophobic material, or alternately, a hydrophilic material. The traction members can be positioned in a nautilus configuration relative to a center of rotation in the forefoot area. The traction members can be positioned in a nautilus configuration relative to a center of rotation in the rearfoot area.

A preferred sole can include lines of flexion such as flex grooves. The lines of flexion can be transverse with respect to the sole. The lines of flexion can be longitudinal with respect to the sole.

The sole can have a substantially planar configuration. Alternately, a preferred sole can have an arcuate or curved configuration which is consistent with portions of the anatomical features of a wearer's foot.

The present invention also teaches a detachable cleat. A preferred detachable cleat can have a base, side, and tip, and can include a resilient and elastomeric hydrophobic material having a wettability index equal to or greater than 90 degrees at the base. The detachable cleat can include a second hydrophobic material on the sides. The tip can include a hydrophilic material. The tip can include an insert consisting of a hard wear resistant material.

An alternate preferred detachable cleat can substantially consist of a hydrophobic material. The detachable cleat can have an annular, elliptical, conical, semi-conical, blade, blade-like, or other configuration.

An alternate preferred detachable cleat can substantially consist of a hydrophobic material. The detachable cleat can have an annular, elliptical, conical, semi-conical, blade, or blade-like configuration. Further, the tip of the detachable cleat can include an insert consisting of a hard wear resistant material.

An alternate preferred detachable cleat can have a base, side, and tip, and a flange including protrusions. The flange and protrusions can substantially consist of a hydrophobic material having a wettability index equal to or greater than 90 degrees. The tip can include an insert consisting of a hard wear resistant material.

A sole for an article of footwear having an anterior side, a posterior side, a medial side, and a lateral side can include a ground engaging surface and protrusions including a tip. The ground engaging surface and protrusions including the tip can be made of a hydrophilic material having a wettability index equal to or greater than 90 degrees. The protrusions can have a width at the tip in the range between 2–4 mm, a height in the range between 3–6 mm, and the closest portion of adjacent protrusions can be spaced at least 3 mm apart. Further, the closest portion of adjacent protrusions can be spaced in the range between 3–6 mm apart. The ground engaging surface can further include a periphery, and a central region, and the central region can be made of a hydrophilic material having a wettability index equal to or greater than 90 degrees, whereas the periphery can be made of a material having a wettability index less than 90 degrees. The periphery portion of the sole can extend at least 4 mm, and thereby more specifically in the range between 4–10 mm. Moreover, the protrusions can be positioned on the ground engaging surface of the sole relative to a center of rotation in a nautilus configuration. Alternately, it can be readily understood that traction members can be positioned on the ground engaging surface relative to a center of rotation in a nautilus configuration.

BRIEF DESCRIPTION OF THE DRAWING FIGURES

FIG. 1 is a top plan view of a sole including a hydrophobic material having a plurality of protrusions, and traction members.

FIG. 2 is a cross-sectional view of the sole shown in FIG. 1, taken along line 2—2.

Figure 4:
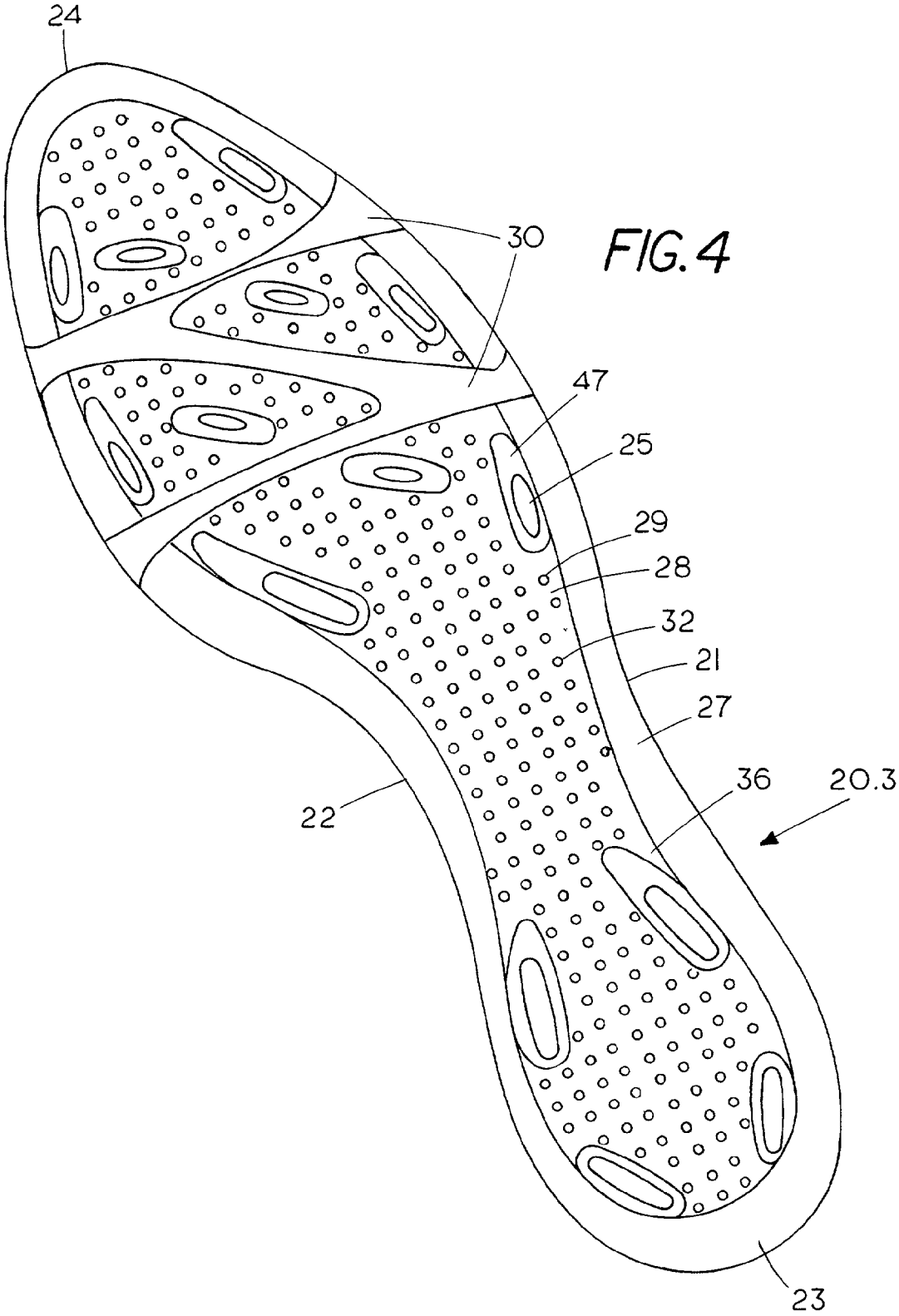
FIG. 4 is a top plan view of an alternate sole including a hydrophobic material having a plurality of protrusions, and traction members.

FIG. 5.1 is a side view of the sole shown in FIG. 4 including a hydrophobic material having a plurality of protrusions, and traction members.

FIG. 5.2 is a side view of a prior art sole having traction members generally similar in shape, but much larger in size than those shown in FIG. 5.1.

FIG. 6.1 is a top plan view of an alternate sole including a hydrophobic material having a plurality of protrusions, and including a nautilus configuration of traction members in the forefoot area.

FIG. 6.2 is a top plan view of an alternate sole generally similar to that shown in FIG. 6.1, but also including a nautilus configuration of traction members in the posterior rearfoot area.

Figure 7:
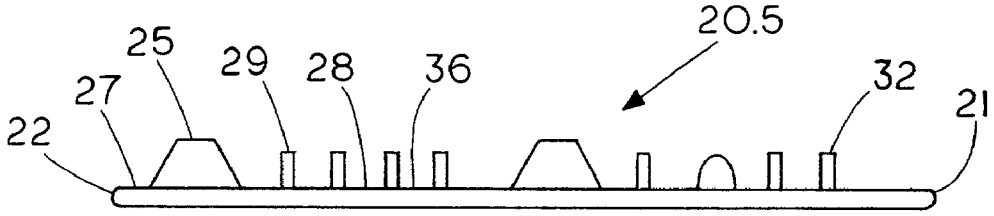

FIG. 7 is a cross-sectional view of the sole shown in FIG. 6.1, taken along line 7—7.

Figure 8:
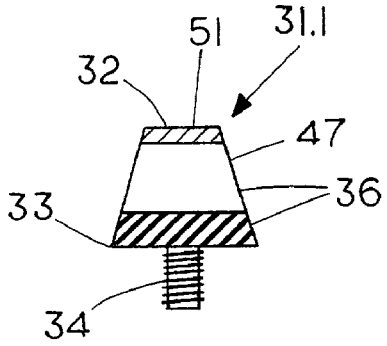

FIG. 8 is a side view of a conical detachable cleat including a hydrophobic material on the sides of the cleat, and an insert at the tip.

Figure 9:
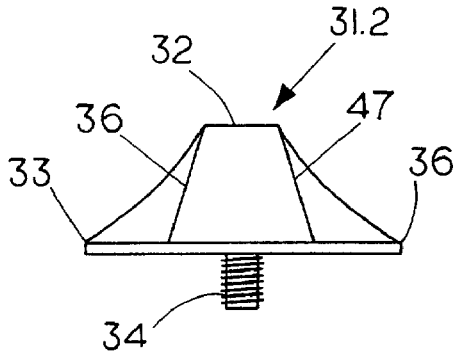

FIG. 9 is a side view of a semi-conical or blade-like detachable cleat including a hydrophobic material.

Figure 10:
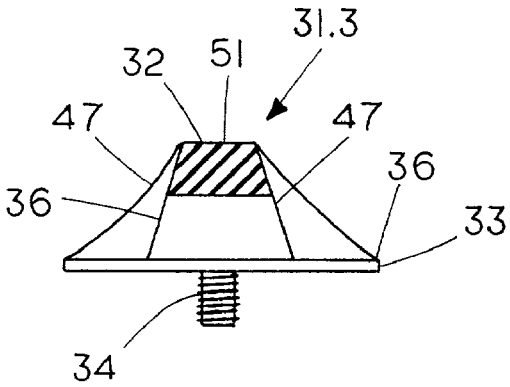

FIG. 10 is a side view of a semi-conical or blade-like detachable cleat including a hydrophobic material, and an insert at the tip.

Figure 11:
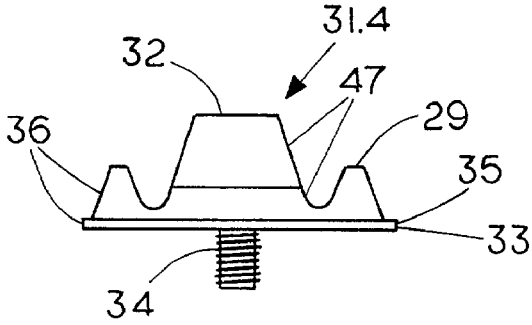

FIG. 11 is a side view of a detachable cleat including a hydrophobic material, and a flange including protrusions.

Figure 12:
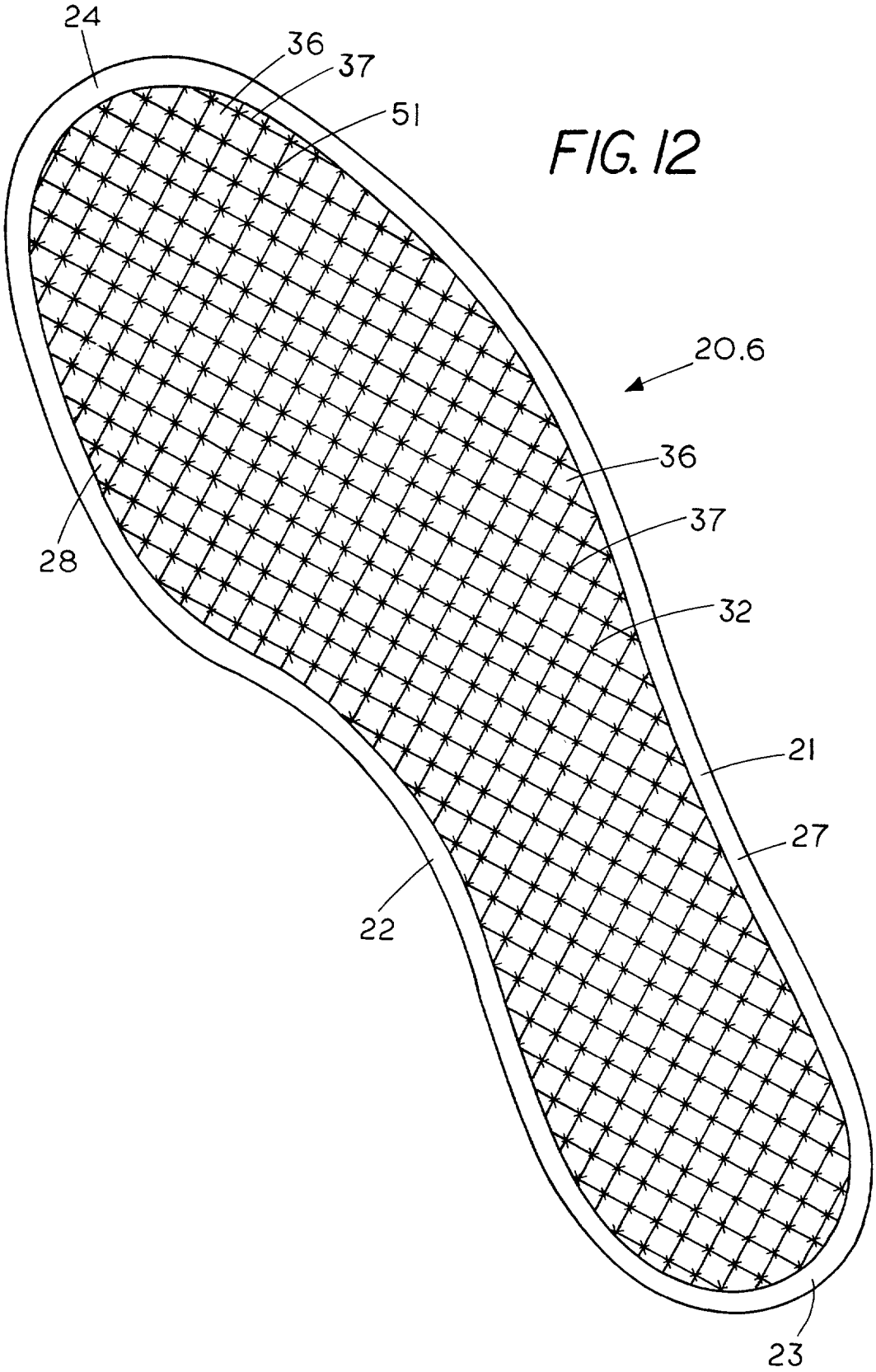

FIG. 12 is a top plan view of a sole including a synthetic textile material having a plurality of protrusions, and including hydrophobic material.

FIG. 13 is a top plan view of a sole including hydrophobic material, a plurality of protrusions, and both longitudinal and transverse lines of flexion.

FIG. 14 is a cross-sectional view of the sole shown in FIG. 13, taken along line 14—14, showing a generally planar sole configuration.

FIG. 15 is a cross-sectional view of an alternate sole similar to that shown in FIG. 14, taken at position consistent with line 14—14, showing an arcuate sole configuration.

DETAILED DESCRIPTION OF THE PREFERRED EMBODIMENTS

The present invention teaches an article of footwear having a non-clogging sole. Reducing the height of traction members, protrusions, lugs, or cleats on an article of footwear can possibly decrease local plantar pressures, enhance comfort, stability and performance, and reduce the risk of certain injuries provided that requisite traction characteristics are not compromised. An article of footwear having a non-clogging sole of the present invention can be used to enhance performance on natural surfaces including natural grass, dirt, or mud, but also on artificial surfaces. In this specification, general reference to a preferred embodiment of a sole, or other structure relating thereto will be made using a descriptive term followed by a numeral. Special reference to a particular embodiment shown in the drawing figures will be made using the relevant descriptive term and numeral, but with the addition of a point or period and a further numerical suffix. Further, the term ground engaging surface shall mean that portion of the sole of an article of footwear which is capable of bearing upon a support surface, and whether that be a natural or synthetic surface.

As shown in FIG. 1, a preferred sole 20.1 for an article of footwear can include a hydrophobic material 36, that is, a material having a wettability index equal to or greater than 90 degrees, a generally planar ground engaging surface 28, and protrusions 29. As shown in FIG. 1, that is, when drawn to 1/1 scale for a men's size 11, the protrusions 29 have a width at the tip 32 of 2 mm, a height of 4 mm, and the closest portions of adjacent protrusions 29 are separated by 4 mm. The sole 20.1 also includes traction members 25 having a height of 6 mm. The traction members 25 can be made of one or more materials which can provide desired static and dynamic friction characteristics in wet or dry conditions for permitting a wearer to walk with relative safety on man made surfaces such as asphalt, cement, and tile, and also to provide desired wear properties. Traction members 25 can be made integral to the sole 20.1, or alternately, traction members 25 can consist of detachable cleats 31. Shown are the lateral side 21, medial side 22, posterior side 23, and anterior 24 side of the sole 20.1, and the location of two lines of flexion 30.

As shown in FIG. 1, the posteriormost line of flexion 30 approximately coincides with the location of a wearer's metatarsal-phalangeal joints. The following U.S. patents and some of the prior art recited therein contain teachings regarding lines of flexion 30 in articles of footwear such as grooves, and the like: U.S. Pat. No. 5,384,973, U.S. Pat. No. 5,425,184. U.S. Pat. No. 5,625,964, U.S. Pat. No. 5,709,954, U.S. Pat. No. 5,786,057, U.S. Pat. No. 5,843,268, U.S. Pat. No. 5,906,872, U.S. Pat. No. 4,562,651, U.S. Pat. No. 4,837,949, and U.S. Pat. No. 5,024,007, all of the recited patents hereby being incorporated by reference herein.

As shown in FIG. 1, the traction members 25 preferably have a height at least equal to or greater than that of protrusions 29. The traction members 25 can have a rounded or curvilinear configuration such as an annular or elliptical shape, or alternately, can be made in more complex and varied configurations. In order to avoid the possibly of inflicting injury to another athlete, e.g., as when playing soccer, it can be advantageous to avoid the introduction of relatively hard or rigid protrusions 29 and traction members 25 within the periphery 27 of the sole 20.1.

The periphery 27 of a sole 20 is hereby defined herein as an area or region extending in the range between 4–10 mm, and preferably approximately 6 mm or ¼ inch, inside of the bottom net 44 or perimeter 46 of the sole 20 as measured along a line drawn perpendicular to a line that is drawn tangent to the bottom net 44 and/or perimeter 46 of a sole 20 at any given point. When an article of footwear 40 includes a sole 20 having an outsole 41 or midsole 42 wrap configuration, that is, the outsole 41 or midsole 42 wraps up about and is affixed to the sides of the shoe upper 43, it is advantageous that the periphery 27 extend in the range between 4–10 mm from the junction point between the outsole 41 or midsole 42 and the shoe upper 43. Preferably, the periphery 27 extends in the range between 4–10 mm from a line defining the visible bottom net 44 and/or perimeter 46 of a given sole 20, as can be seen in an engineering mold drawing or captured by still photograph in a bottom plan view.

Again, in order to prevent player injuries which could be associated with kicking blows during soccer play, it can be advantageous to not position traction members 25 or protrusions 29 within the periphery 27. Alternately, traction members 25 and protrusions 29 which are located within the periphery 27 can have reduced height relative to those located in the central region 45 of a sole 20. Further, the hardness of the material used to make traction members 25 or protrusions 29 which are located in the periphery 27 can be relatively soft as compared with those located in the central region 45 of a sole 20.

It can be advantageous to use a material having good traction characteristics about the periphery 27 of a sole 20. Further, it can be advantageous to use a material having good traction characteristics proximate the anterior 24 and posterior 23 portions of a sole 20. For this reason, it can sometimes be advantageous to use material having a wettability index less than or equal to 80 degrees in the periphery 27, and also proximate the anterior 24 and posterior 23 portions of a sole 20. Alternately, a material having a wettability index greater than 80 degrees, or even greater than 90 degrees can sometimes be used provided that such a material be characterized as relatively soft, as measured on a Shore Durometer scale, e.g., the A or D Shore Durometer scales. Accordingly, when traction members 25 or protrusions 29 having a wettability index greater than 80 degrees, or even greater than 90 degrees are positioned within the periphery 27 of a sole 20, it can be advantageous that the hardness of the material for use in the periphery 27 be in the range between 30 and 90 Shore A, whereas the material for use in the central region 45 can be in the range between 30 and 100 Shore A, or even above 80 on the Shore D scale that is generally used to measure harder materials.

As shown in FIG. 1, traction members 25 can be encompassed by a border 26 which can made from a hydrophobic material 36, or alternately, a different material composition that is hydrophilic. The border 26 can be made of the same material as the traction members 25, or the material used in the periphery 27, or alternately, a different material. The traction members 25 can be made of the same material used in the central region 45 and to make the protrusions 29, or alternately, can be made of the material which is used in the periphery 27, border 26, or some other combination. The presence of border 26 can be associated with the use of traction members 25 which further consist of detachable cleats 31, e.g., as shown in FIGS. 4b, 5, and 6 in U.S. Pat. No. 5,832,636, and FIGS. 8–11 herein, and in particular, detachable cleats 31 which have a broad flange 35 extending therefrom, and the like. Traction members 25 or detachable cleats 31 can be made of metal such as stainless steel, aluminum, or titanium, a metal matrix composite, a glass or carbon fiber composite, a thermoplastic material such as nylon, a natural or synthetic rubber material, an elastomer such as polyurethane, or combinations of these materials. Alternately, as shown in FIG. 4, a sole 20.3 can substantially or wholly exclude the presence of a border 26 about traction members 25, or detachable cleats 31. Accordingly, the hydrophobic material 36 having a wettability index equal to or greater than 90 degrees can be used on the ground engaging surface 28 of the sole 20.3 adjacent to the base 33 of traction members 25 or detachable cleats 31. Further, the traction members 25 or detachable cleats 31 can comprise a hydrophobic material 36.

Generally, materials which are hydrophobic and have a wettability index equal to or greater than 90 degrees will also exhibit low coefficients of static and dynamic friction and provide poor traction on man made or natural surfaces. However, while generally valid, this relationship is not a necessary or determinate one. In particular, the hardness of the material which is used to make traction members 25 or protrusions 29, and the like, can greatly influence the exhibited traction characteristics of the sole 20 when engaged with either a natural or artificial surface. In this regard, a relatively hard hydrophobic material having a wettability index equal to or greater than 90 degrees normally provides poor traction characteristics relative to one which is softer. For example, an ultra high molecular weight (UHMW) polyethylene material having a wettability index of approximately 97.4 degrees and having a hardness of 90 Durometer on the Shore A scale will afford poorer traction characteristics relative to a silicone rubber material having a Shore A hardness of 50 Durometer even though the silicone rubber material can exhibit a wettability index higher than that of the polyethylene material. Accordingly, a relatively soft hydrophobic material having a wettability index equal to or greater than 90 degrees can provide a tactified surface and afford better traction for use on man made surfaces than a relatively hard hydrophobic material. However, there is a tendency for softer hydrophobic materials to have diminished abrasion resistance and wear properties, and so a practical lower threshold can exist regarding the softness of a hydrophobic material which can be advantageous for use in certain applications. Nevertheless, the present invention teaches a sole 20 in which both the protrusions and traction elements can possibly be made of a hydrophobic material.

When it is desired to made protrusions, traction members, lugs, or cleats of a hydrophobic material having a wettability index of equal to or greater than 90 degrees, most of the so-called "Type I" neat polymers recited in U.S. Pat. No. 5,832,636 in Column 6 line 11 though Column 7 line 18 can be too hard to provide desired traction characteristics on man made surfaces such as asphalt, cement and tile. The silicone family of materials is probably the most notable exception in this group, but some formulations of UHMW polyethylene can also be suitable for use.

Alternately, when it is desired to made traction members, lugs, or cleats of a hydrophobic material having a wettability index of equal to or greater than 90 degrees which will provide desired traction characteristics on man made surfaces such as asphalt, cement and tile, so-called "Type II" polyblend materials can provide a wider selection of suitable materials. FLOUREL® and AFLAS® fluorothermoplastics and elastomer polyblends made by Dyneon, a joint enterprise of the Minnesota Mining and Manufacturing (3M) of St. Paul, Minn., and Hoechst companies can be suitable for use. Further, VITON®, a fluoroelastomer made by I.E. Du Pont de Nemours of Wilmington, Del. can possibly be used. A wide variety of fluorinated chemical products are available through Sigma-Aldrich, of Milwaukee, Wis., e.g., see the catalogue entitled "Fluorinated Products." Examples of other thermoplastic elastomer materials for use in making polyblend materials include those made by Advanced Elastomer Systems of Akron, Ohio such as SANTOPRENE®, VISTAFLEX®, VYRAM ®, GEOLAST®, TREFSIN®, DYTROL XL®, and taught in the following U.S. Pat. Nos.; 5,783,631, 5,779,968, 5,777,033, 5,777,029, 5,750,625, 5,672,660, 5,609,962, 5,591,798, 5,589,544, 5,574,105, 5,523,350, 5,403,892, 5,397,839, 5,397,832, 5,349,005, 5,300,573, 5,290,886, 5,177,147, 5,157,081, 5,100,947, 5,086,121,5,081,179, 5,073,597, 5,070,111, 5,051,478, 5,051,477, 5,028,662, and RE 035398. SANTOPRENE® is known to consist of a combination of butyl rubber and ethylene-propylene. Further, Advanced Elastomer Systems has developed a particular formulation of SANTOPRENE® which is capable of bonding to Nylon. Generally, polyblends containing silicone, ethylene or polyethylene, or fluorinated materials can possibly be suitable for use.

At least one example of a so-called "Type II" polyblend intended to reduce clogging exists in the footwear prior art. In the early 1960's, the United States Army developed a clog resistant sole for use in tropical conditions known as the "Panama Sole" that is still in service today. The sole of this article of footwear was somewhat cantilevered. Further, a vulcanized rubber compound was developed for use which included ethylene and this conveyed clog resistant characteristics to the sole. Information on the development of the "Panama Sole" can be obtained from the Natic Research Laboratory in Natic, Mass. and the Office of the Quartermaster General. Present manufacturers of the "Panama Sole" include Altama Delta, Inc. located in Atlanta, Ga., and Ro-Search associated with the Welco, Corporation located in Wainsville, Tenn.

Alternately, when it is desired to make protrusions, traction members, lugs, or cleats of a hydrophobic material having a wettability index of equal to or greater than 90 degrees which will provide desired traction characteristics on man made surfaces such as asphalt, cement and tile, so-called "Type III" surface active additives, surfactants, and fillers can be included in a parent material rending the resultant material hydrophobic and resistant to clogging. For example, suitable fillers, waxes, oils, or surfactants such as ZONYL® fluorosurfactants made by I.E. Du Pont de Nemours, Inc. of Wilmington, Del. can be used with a plastic material, a natural or synthetic rubber material such as styrene butadiene rubber or nitrite rubber, an elastomer such as polyurethane, or thermoplastic elastomer to make traction members.

FIG. 2 is a cross-sectional view of the sole 20.1 shown in FIG. 1 taken along line 2—2. Traction members 25 have greater height than protrusions 29. Accordingly, a wearer will substantially tread on traction members 25 when walking on most rigid man-made surfaces such as asphalt, concrete, or tile. As shown in FIG. 2, that is, when drawn to 1/1 scale, the traction members 25 only have a height or elevation of approximately 6 mm from the generally planar ground engaging surface 28 of the sole, whereas it is common to find like conical shaped traction members 25 on prior art soles 20.4 having a height equal to or greater than 10 mm, as shown in FIG. 5.2. However, traction members 25 can have a height other than approximately 6 mm, and the height of various traction members 25 included on a particular sole 20 can be varied. The preferred protrusions 29 have a width at the tip 32 in the range between 2–4 mm, a height in the range between 3–6 mm, and the closest portion of adjacent protrusions 29 are spaced apart by at least 3 mm. Further, the closest portion of adjacent protrusions 29 can be spaced apart in the range between 3–6 mm. Accordingly, as shown in FIG. 2, that is, when drawn to 1/1 scale, the protrusions 29 can have a width of 2 mm at the tip 32, a height of 4 mm, and a side spacing of 4 mm between the closest portions of adjacent protrusions 29. Alternately, it can be readily understood that the preferred protrusions 29 can have a width of 3 mm at the tip 32, a height of 6 mm, and also a side spacing of 6 mm. The reasons for the aforementioned preferred dimensions and spacing will now be addressed.

Generally, it is desired for the protrusions 29 to mechanically engage and exhibit a comb or brush like action with respect to a natural grass surface. At the same time, it is not desired that the protrusions 29 and hydrophobic material 36 become filled with blades of grass that have become skewered thereupon or mechanically lodged therebetween. The prevalent width and height of the grass surface on athletic fields can influence selections with respect to optimal protrusion height and spacing. However, most natural grasses or the synthetic turf normally used on athletic fields have a blade width of approximately 2 mm. It would be rare to find natural grass having a blade width greater than 4 mm given the grass species which are commonly being cultivated and used on athletic fields. Of course, the possible growth of other undesired broad leaf weeds and so-called "crab-grass" can degrade and alter the composition of a natural grass athletic field, and the blade width of such undesired weeds or grasses can sometimes exceed 4 mm. Obviously, synthetic turf surfaces are not subject to this problem.

U.S. Pat. No. 3,888,026 to Adolf Dassler entitled "Running Sole For Sports Shoe," hereby incorporated by reference herein, teaches a sole made of a textile material such as polyester which is coated with a synthetic resin or epoxy. This sole material has been used with articles of footwear for competition in track and field and cross-country. A plurality of fiber bristles are taught which have a somewhat rectangular shape and width dimensions at the tip 32 which are approximately in the range between 1.5–2 mm by 0.65–1 mm, a height in the range between 1.5–3 mm, and row spacing of 3 mm. The row spacing of the somewhat rectangular fiber bristles found in the Adidas products which were commercialized measure approximately 3 mm on center with respect to adjacent fiber bristles, thus the true effective distance as between adjacent fiber bristles is only in the range between 1–2 mm, and in particular, after the fiber bristles begin to degrade by compacting and widening due to normal wear. As result of their shape and close spacing the fiber bristles and sole initially can provide good traction on a natural grass surface for only a relatively short period of time. Blades of grass quickly become skewered upon and lodged between the adjacent fiber bristles thereby clogging the sole and degrading the traction afforded by the article of footwear which is rendered unserviceable.

In the present invention, a plurality of protrusions 29 can consist of fiber bristles, or alternatively, a thermoplastic material, a thermoset rubber material or an elastomer such as polyurethane, and the like. Further, it can be advantageous that the protrusions 29 be made with rounded or curvilinear contours. The preferred protrusions 29 have a width at the tip 32 in the range between 2–4 mm, a height in the range between 3–6 mm, and the closest portion of adjacent protrusions 29 are spaced apart at least 3 mm. Further, the closest portion of adjacent protrusion 29 can be spaced apart in the range between 3–10 mm, and in particular, in the range between 3–6 mm. Accordingly, blades of natural grass having a width of approximately 2 mm will be cut rather than skewered by the projections, and the side spacing of the projections does not permit blades of grass to become easily lodged therebetween. As shown in FIG. 2, the protrusions 29 can have a width of 2 mm at the tip 32, a height of 4 mm, and also a side spacing of 4 mm, that is, as measured between the closest portions of adjacent protrusions 29. When taken in synergistic combination with the use of a hydrophobic material 36 having a wettability index equal to or greater than 90 degrees, the aforementioned dimensions and physical characteristics of the protrusions 29 including the tip 32 can substantially eliminate clogging of a sole 20 by those species of grass commonly used on athletic fields. Even when a material having a wettability index less than 90 degrees is used on a sole 20, it can be readily understood that the aforementioned configuration and spacing of protrusions 29 can be advantageous.

Accordingly, it can be readily understood from the teachings contained herein that the use of a hydrophobic material having a wettability index equal to or greater than 90 degrees is a necessary condition, but it is not a sufficient condition for creating a non-clogging sole including a plurality of projections or traction members. The reason being that the magnitude of the mechanical forces associated with blades of natural grass possibly becoming skewered upon, or alternately wedged between adjacent protrusions or traction members can nevertheless overcome and predominate over the repulsive surface energy associated with the use of a hydrophobic material. Further, it can be readily understood from the teachings contained herein that the width at the tip of a protrusion or traction member must be equal to or greater than a critical minimum threshold of 2 mm corresponding to the approximate width of the blades of those species of natural grasses commonly used on athletic fields, as otherwise blades of grass will easily become skewered thereupon resulting in build-up and clogging of a sole. Further, it can be readily understood from the teachings contained herein that a maximum recited width of 4 mm at the tip of a projection or traction member can be advantageous for athletic performance under normal conditions for effecting optimal penetration and mechanical engagement with a natural grass surface. In addition, it can be readily understood from the teachings contained herein, and also those found in U.S. Pat. No. 5,761,833 to Faris McMullin which has previously been incorporated by reference herein, that a minimum height of the projections or traction members corresponding to approximately 3 mm is required under normal conditions for effecting optimal penetration and mechanical engagement with a natural grass surface. Further, it can be readily understood from the teachings contained herein, that a maximum height for the projections or traction members corresponding to approximately 6 mm can be advantageous under normal conditions for avoiding the introduction of the high local plantar pressures, instability, undesired foot fixation and greater risk of injury associated with many conventional prior art articles of footwear. Moreover, it can be readily understood from the teachings contained herein that a critical minimum spacing exists of approximately 3 mm between the closest portion of adjacent protrusions or traction members in order to prevent blades of the natural grass species commonly used on athletic fields that have an approximate width of 2 mm from becoming mechanically lodged therebetween, thus resulting in build-up and clogging of the sole. It can also be readily understood from the teachings contained herein that a maximum spacing of approximately 6 mm between the closest portion of adjacent protrusions or traction members can be advantageous for enhancing friction with the blades of natural grass or artificial turf, and also traction upon a support surface. In sum, the creation of an article of footwear having a non-clogging sole which can provide enhanced performance characteristics on natural surfaces requires a synergistic combination of a hydrophobic material having a wettability index equal to or greater than 90 degrees with protrusions or traction members having specific width, height, and spacing dimensions. For example, if the minimum or maximum critical dimensions associated with the protrusions or traction members, or any other necessary part of the synergistic whole is greatly compromised, the non-clogging capability of the sole can easily be lost and the overall performance characteristics of an article of footwear substantially degraded. These discoveries and facts were not known or obvious even to the present inventor when U.S. Pat. No. 5,832,636 entitled "Article of Footwear Having Non-Clogging Sole," taught by the present inventor and Souheng Wu, was granted on Nov. 10, 1998.

Figure 3:
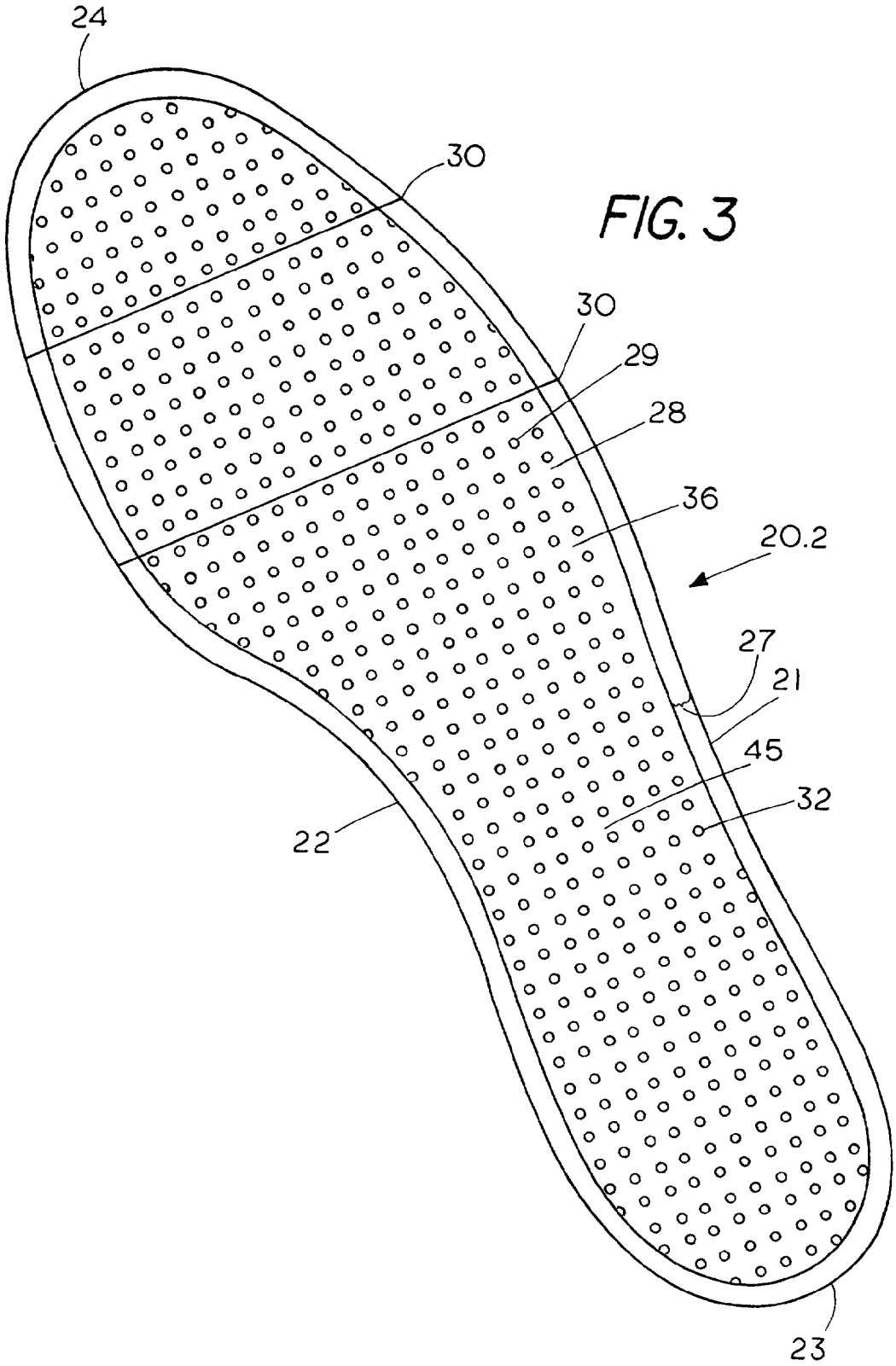
FIG. 3 is a top plan view of a sole including a hydrophobic material having a plurality of protrusions.

FIG. 3 is a top plan view of an alternate preferred sole 20.2 including a hydrophobic material 36, and a plurality of protrusions 29 extending from the generally planar ground engaging surface 28 of the sole 20.2. Alternately, the hydrophobic material 36 can be used in the central region 45 of the sole 20.2, but not within the periphery 27. In the embodiment shown in FIG. 3, the hydrophobic material 36 is used over substantially the entire ground engaging portion of the sole 20.2. The preferred protrusions 29 have a width at the tip 32 in the range between 2–4 mm, a height in the range between 3–6 mm, and the closest portion of adjacent protrusions 29 are spaced at least 3 mm apart. Further, the closest portion of adjacent protrusion 29 can be spaced apart in the range between 3–10 mm, and in particular, in the range between 3–6 mm. Accordingly, as shown in FIG. 3, that is, when drawn to 1/1 scale, the protrusions 29 can have a width at the tip 32 of 2 mm, a height of 4 mm, and also a side spacing of 4 mm, that is, as measured between the closest portions of adjacent protrusions 29. It can be advantageous and prudent that an article of footwear 40 including a relatively hard hydrophobic material 36 be worn only on natural grass or synthetic turf playing surfaces, both from the standpoint of durability and safety. When a relatively soft hydrophobic material, or alternately, a material having a wettability index less than 90 degrees is used, then an article of footwear 40 having a sole 20.2 can sometimes be used for walking on hard man-made surfaces such as asphalt, concrete, and tile. As shown in FIG. 3, the sole 20.2 can include lines of flexion 30 such as flex grooves, or alternately, can be made relatively thin and flexible.

FIG. 4 is a top plan view of an alternate preferred sole 20.3 including a hydrophobic material 36, a plurality of protrusions 29, and traction members 25. The configuration of the traction members 25 is somewhat similar to that shown in U.S. Design Pat. No. 387,892, granted to Antoine Briand, and commercialized by Adidas A.G. The substantially rounded and complex curvilinear configuration of the traction members 25 is believed to facilitate rotative movements of the article of footwear 40 in relation to the ground support surface when the foot is planted. This is believed to enhance performance and reduce the risk of possible injury to a wearer's ankle or knee due to fixation of the foot and article of footwear 40 with respect to the ground support surface. If desired, the material used to make the base 33, side 47, and tip 32 of the traction members 25, the periphery 27, and those areas associated with lines of flexion 30 can consist of a material having a wettability index equal to or greater than 90 degrees.

FIG. 5.1 is a side view of the sole 20.3 shown in FIG. 4 including a hydrophobic material 36, a plurality of protrusions 29, and traction members 25. Again, it can be advantageous that traction members 25 have a height equal to or greater than protrusions 29. As shown in FIG. 5.1, that is, when drawn to 1/1 scale, the traction members 25 are only elevated approximately 6 mm from the generally planar ground engaging surface 28 of the sole 20.3, whereas it is common to find traction members 25 on prior art soles having a height equal to or greater than 10 mm. The preferred protrusions 29 have a width at the tip 32 in the range between 2–4 mm, a height in the range between 3–6 mm, and the closest portion of adjacent protrusions 29 are preferably spaced at least 3 mm apart. Further, the closest portion of adjacent protrusion 29 can be spaced apart in the range between 3–10 mm, and in particular, in the range between 3–6 mm, and likewise, the spacing between adjacent protrusions 29 and traction members 25. As shown in FIG. 5.1, that is, when drawn to 1/1 scale, the protrusions 29 have a width at the tip 32 of 2 mm, a height of 4 mm, that is, the protrusions 29 extend 4 mm from the generally planar ground engaging surface 28 of the sole 20.3, and the closest portions of adjacent protrusions 29 are spaced 4 mm apart. Accordingly, a wearer will substantially tread on traction members 25 when walking on most rigid man-made surfaces such as asphalt, concrete, and tile.

FIG. 5.2 is a side view of a prior art sole 20.4, shown in FIG. 4 of U.S. Design Pat. No. 387,892 granted to Antoine Briand and commercialized by Adidas A.G., having traction members 25 with a generally similar configuration, but much larger size than those shown in FIG. 5.1 Accordingly, FIG. 5.2 serves to help illustrate the relative dramatic reduction in height of the wearer's foot relative to the ground support surface which can be attained while using an article of footwear including a sole similar to that shown in FIG. 5.1, and the like.

FIG. 6.1 is a top plan view of an alternate preferred sole 20.5 including a hydrophobic material 36, and a plurality of protrusions 29, and traction members 25. As shown in FIG. 6.1, that is, when drawn to 1/1 scale, the protrusions 29 have a width at the tip 32 of 2 mm, a height of 4 mm, and the closest portion of adjacent protrusions 29 are spaced 4 mm apart, whereas the traction members 25 have a height of 6 mm. The traction members 25 located in the area of the forefoot 48 are orientated in a nautilus configuration 50, as shown by a dashed line. The center of rotation 38 with respect to the nautilus configuration 50 can be located centrally with respect to the forefoot 48 as shown, or alternately, the center of rotation 38 can be biased towards the medial side 22, or the lateral side 21 of the sole 20.5. As shown in FIG. 6.1, the most central traction member 25 can be positioned at the center of rotation 38, or alternately, the most central traction member 25 can be positioned at some distance from the center of rotation 38. The radius 39 as measured from the center of rotation 38 to the nearest traction member 25, and then each nearest succeeding traction member 25 constantly increases in accordance with the spiral like nautilus configuration 50, or otherwise varies in a like manner.

All things being equal, a nautilus configuration 50 of traction members 25 can better facilitate rotative movement of a wearer's foot relative to the traditional configuration shown in FIG. 1, or the more contemporary configuration shown in FIG. 4, or circular configurations of traction members known in the prior art which are positioned at a constant radius from a central pivot point. Indirect support for this can be found in two recent prior art patents assigned to Nike, Inc. and Adidas-Salomon AG. In particular, PCT Patent WO 99/22615 by Derek Campbell and Peter Backus entitled "Golf Shoe Outsole With Pivot Control Traction Elements" assigned to Nike, Inc. teaches a golf shoe having a plurality of traction projections which can be arranged in an elliptical configuration around a center of rotation, as opposed to a circular configuration, and this patent is hereby incorporated by reference herein. However, the traction projections have a lengthwise portion that is orientated in the general direction of the center of rotation or pivot point, thus the traction projections are configured and orientated so as to inhibit rotation, rather, to enhance traction during the full golf swing motion. This characteristic is generally the opposite of what is desired and advantageous for use in an article of footwear that is intended for soccer play and other lateral movement sports that require a relative ease of rotation and where rotational foot fixation can be associated with an increased risk of injury. U.S. Pat. No. 5,873,184 to Frederick Ihlenburg entitled "Cleated Athletic Shoe Sole For Traction And Stability" and assigned to Adidas-Salomon A.G. teaches a sole for a sport shoe to provide increased traction and stability, and this patent is hereby incorporated by reference herein. In particular, see the discussion in U.S. Pat. No. 5,873,184 at column 1, lines 1–67; column 2, lines 1–34; column 3, lines 17–30; column 4, lines 5–17; and, column 4, lines 61 continuing through column 5, lines 1–17. This reference is primarily directed towards an article of footwear that is intended for use in baseball, but it contains some valid general biomechanical observations and criticism of prior art cleated or spikes shoes. However, this reference does not teach projections or traction members positioned in a nautilus configuration.

One of the problems with prior art articles of footwear which have traction members arranged in a circular configuration as taught, e.g., in U.S. Pat. No. 4,347,674 granted to George, U.S. Pat. No. 4,670,997 granted to Beekman, and U.S. Pat. No. 4,689,901 granted to Ihlenburg, that is, the traction members are positioned at an equal radius from a center of rotation, stems from the fact that it is not normal or natural for an individual to rotate and pivot while running on a natural grass or artificial turf surface during soccer play about a single geometric point in the manner of a ballerina. In fact, it is seldom if ever the case that a soccer player is standing still and rotating, rather, there is normally some degree of forward, rearward, and/or sideward motion taking place in combination with rotation. Accordingly, the center of gravity of the player and both the path and center of plantar pressure do not follow a path of circular rotation about a single pivot point, as can be seen and recorded using measuring devices such as a Kistler force plate made by the Kistler Instrument Corporation of Amherst, N.Y., the F-scan system made by Tekscan, Inc. of Boston, Mass., and both the EMED and PEDLAR systems made by Novel Gmbh of Munich, Germany or Novel Electronics, Inc. of St. Paul, Minn.

Further, another problem with prior art teachings which position traction members having substantial height in a circular configuration is that the traction member which leads in the direction of rotational movement can dig a groove in a natural grass surface that can guide and capture those traction members which can then follow along the same path of least resistance. This can result in an undesired amount of foot fixation during rotative movement and can place large loads upon a wearer's ankle and knee thereby increasing the risk of injury such as an ankle sprain or a torn anterior cruciate ligament. In brief, the present inventor holds that is not desired or advantageous for an article of footwear for use in soccer play to rotate about a single point, nor to stop too suddenly. It is natural and normal for both the center of rotation and the center of plantar pressure to be shifted about in the forefoot area during movement, thus desirable for an article of footwear to permit and facilitate this action. This normally requires a relatively small and biomechanically harmonic amount of deflection or side movement that generally measures in the range between 4–10 mm along the transverse plane, and also for the traction members to be capable of easily withdrawing and releasing from the ground support surface. The arrangement of a plurality of relatively short traction members in a nautilus configuration, each having a slightly different radius from a given center of rotation, can serve to facilitate the required amount of side movement along the transverse plane, and also the easy withdrawal and release of the traction members from the ground support surface.

While the number of possible center of plantar pressure paths which might be recorded with numerous individuals and maneuvers approaches infinity, the resulting patterns often form semi-curved shapes which resemble at least a portion or segment of a spiral like nautilus configuration. For this reason, an article of footwear having protrusions or traction members positioned in a nautilus configuration can be especially suitable for use. Further, since each adjacent traction member is positioned at a different radius from a given center of rotation on a preferred article of footwear, and the protrusions and traction members recited herein have a relatively short height, they are better able to follow their own paths, and both hold and release in a more controllable and predictable manner. Accordingly, it can be advantageous to use an article of footwear having a nautilus configuration with respect to traction members on natural grass surfaces or artificial turf. In contrast, prior art traction members arranged in a circular configuration having a substantial height tend to become trapped within deep grooves created in natural grass surfaces. In addition, even when a portion of a wearer's foot is being unloaded and begins to move upwards in order to release prior art traction members having a substantial height during rotation, this action will necessarily be hindered and delayed due to their depth of penetration.

However, in order to provide desired traction characteristics with shorter protrusions or traction members, a greater number will normally be required, and generally, the shorter the height of the protrusions or traction members, the greater the number that will be required. The direct consequence of introducing numerous relatively short protrusions or traction members is that they become spaced in closer proximity. This commonly leads to clogging and degradation of the traction characteristics and overall performance. The present invention successfully resolves this dilemma and "Catch-22" situation by the synergistic use of a hydrophilic material having a wettability index equal to or greater than 90 degrees with protrusions or traction members having specific required dimensions, and in particular, a width at the tip of at least 2 mm, a height in the range between 3–6 mm, and the closest portion of adjacent protrusions or traction members are spaced at least 3 mm apart. Further, the closest portion of adjacent protrusion can be spaced apart in the range between 3–10 mm, and in particular, in the range between 3–6 mm.

FIG. 6.2 shows a sole 20.9 generally similar to that shown in FIG. 6.1, but also including a nautilus configuration 50 of traction members 25 in the rearfoot area 49.

FIG. 7 is a cross-sectional view of the sole 20.5 shown in FIG. 6.1 taken along line 7—7. The sole 20.5 includes a hydrophobic material 36 having a plurality of protrusions 29, and traction members 25. Again, it can be advantageous that traction members 25 have a height equal to or greater than protrusions 29. As shown in FIG. 7, that is, when drawn to 1/1 scale, the traction members 25 are elevated approximately 6 mm from the generally planar ground engaging surface 28 of the sole 20, whereas it is common to find like conical shaped traction members on prior art soles having a height equal to or greater than 10 mm. The preferred protrusions 29 have a width at the tip 32 in the range between 2–4 mm, a height in the range between 3–6 mm, and the closest portion of adjacent protrusions 29 are spaced apart at least 3 mm. Further, the closest portion of adjacent protrusion 29 can be spaced apart in the range between 3–10 mm, and in particular, in the range between 3–6 mm. As shown in FIG. 7, that is, when drawn to 1/1 scale, the protrusions 29 have a width at the tip 32 of 2 mm, a height of 4 mm, and the closest portions of adjacent protrusions 29 are spaced 4 mm apart. Accordingly, a wearer will substantially tread on traction members 25 when walking on most rigid man-made surfaces such as asphalt, concrete, and tile.

FIG. 8 is a side view of a conical detachable cleat 31.1 including a resilient and elastomeric hydrophobic material having a wettability index greater than 90 degrees at the base 33, a second hydrophobic material having a wettability index equal to or greater than 90 degrees on the sides 47, and a hydrophilic material having a wettability index less than 90 degrees on the tip 32 of the cleat 31.1, and affixing means such as a threaded bolt 34. The tip 32 of the cleat 31.1 can include an insert 51 made of a relatively hard and long wearing metal material such as stainless steel, aluminum, titanium, a carbide metal, a ceramic material or alternately, the tip 32 can be made of a thermoplastic material such as nylon, an elastomer such as polyurethane, or combinations of these materials. The use of a resilient and elastomeric hydrophobic material 36 at the base 33 can permit radial, axial, and compressive movement of the cleat 31.1, thus can reduce the shock loads and local plantar pressures experienced by a wearer. The same hydophobic material 36 can be used on the sides 47 of the cleat 31.1, or alternately, a harder hydrophobic material 36 can be used. It can be readily understood that the detachable cleats 31 shown in FIGS. 8–11 can include mating male or female portions, or other means for being mechanically engaged by a suitable tool for affixing the cleats 31 in functional relation to an article of footwear 40.

FIG. 9 is a side view of a semi-conical or blade-like detachable cleat 31.2 which is substantially made of a hydrophobic material 36, that is, the hydrophobic material 36 does not merely consist of a relatively thin coating. Accordingly, as the cleat 31.2 wears a hydrophobic material 36 will always be present on the contact surfaces. The cleat 31.2 can be made of a resilient and elastomeric thermoplastic material, a natural or synthetic thermoset rubber material, or a polyurethane material further including hydrophobic material content. The base 33, sides 47 and tip 32 of the cleat 31.2 can be made of the same hydrophobic material or different hydrophobic materials.

FIG. 10 is a side view of a semi-conical or blade-like detachable cleat 31.3 which is generally similar to that shown in FIG. 9 including a hydrophobic material 36 on the base 33, and a portion of the sides 47 of the cleat 31.3. However, as shown in FIG. 10, the tip 32 of the cleat 31.3 can further include an insert 51 made of a relatively hard wear resistant material, such as those previously recited.

FIG. 11 is a side view of a semi-conical detachable cleat 31.4 with a base 33 including a flange 35 having protrusions 29, and including a hydrophobic material 36 on the inferior portion of the sides 47. The tip 32 and superior portion of the sides 47 of the cleat 31.4 can also be made of a hydrophobic material, or alternately, a hydrophilic material. Optionally, the tip 32 of the cleat 31.4 can further include an insert 51 made of a relatively hard wear resistant material, such as those previously recited. The general configuration of cleat 31.4 as shown in FIG. 11 can provide non-clogging performance, and also possibly enhance traction. A detachable cleat 31.4 having a similar general configuration can be used, e.g., on articles of footwear intended for use in soccer, football, rugby, lacrosse, and given suitable reduction in the diameter of the tip 32, also on articles of footwear intended for use in cross-country, and golf.

FIG. 12 is a top plan view of an alternate preferred sole 20.6 including a textile material 37 having a plurality of fiber bristles 51 which extend from a carrier or generally planar ground engaging surface 28. The generally planar ground engaging surface 28 can include a hydrophobic material 36 having a wettability index equal to or greater than 90 degrees. U.S. Pat. No. 3,888,026 to Adolf Dassler entitled "Running Sole For Sports Shoe," hereby incorporated by reference herein, teaches a sole made of a textile material such as polyester which is coated with a synthetic resin or epoxy. A plurality of fiber bristles are taught which have a somewhat rectangular shape and width dimensions at the tip 32 approximately in the range between 1.5–2 mm by 0.65–1 mm, a height in the range between 1.5–3 mm, and a row spacing of 3 mm. The row spacing of the somewhat rectangular fiber bristles found in Adidas products which were commercialized measure approximately 3 mm on center, thus the true effective distance as between adjacent fiber bristles is between 1–2 mm, and in particular, after the fiber bristles begin to degrade, compact, and broaden due to normal wear. As result of their shape and close spacing the fiber bristles and sole commercialized by Adidas initially provides good traction on a natural grass surface for a relatively short period of time. However, blades of grass quickly become skewered upon the fiber bristles, and also lodged between adjacent fiber bristles, thus clogging the sole and degrading the traction afforded by the article of footwear.

The present invention teaches a somewhat similar textile material 37, but one having preferred fiber bristles 51 having a width at the tip 32 in the range between 2–4 mm, a height in the range between 3–6 mm, and the closest portions of adjacent fiber bristles 51 are spaced apart at least 3 mm. Further, the closest portion of adjacent fiber bristles 51 can be spaced apart in the range between 3–10 mm, and in particular, in the range between 3–6 mm. Accordingly, as shown in FIG. 12, that is, when drawn to 1/1 scale, the fiber bristles 51 can have a width at the tip 32 of 2 mm, a height of 4 mm, and a side spacing of 4 mm as measured between the closest portions of adjacent fiber bristles 51. It can be advantageous that the preferred fiber bristles 51 have rounded or curvilinear contours. The preferred textile material 37 and fiber bristles 51 can consist of a hydrophobic material having a wettability index of equal to or greater than 90 degrees. Alternately, a textile material 37 including fiber bristles 51 having a wettability index less than 90 degrees can be used in combination with a coating consisting of a hydrophobic material 36 having a wettability index equal to or greater than 90 degrees. A textile material 37 including fiber bristles 51 having a wettability index less than 90 degrees can be used, but such will generally not provide optimal performance relative to one having a wettability index equal to or greater than 90 degrees. It can be readily understood that a preferred textile material 37 which includes a hydrophobic material having a wettability index equal to or greater than 90 degrees can be used in combination with a sole including traction members or detachable cleats.

FIG. 13 is a top plan view of an alternate preferred sole 20.7 including hydrophobic material 36, a plurality of protrusions 29, and both longitudinal and transverse lines of flexion 30. As shown in FIG. 13, that is, when drawn to 1/1 scale, the protrusions 29 have a width at the tip 32 of 3 mm, a height of 6 mm, and the closest portions of adjacent protrusions 29 are spaced apart 6 mm. This alternate embodiment of a sole 20.7 can be suitable for use in soccer, football, rugby, lacrosse, cross-country, and golf. Again, the following U.S. patents and some of the prior art recited therein contain teachings with respect to lines of flexion 30 in articles of footwear: U.S. Pat. No. 5,384,973, U.S. Pat. No. 5,425,184. U.S. Pat. No. 5,625,964, U.S. Pat. No. 5,709,954, U.S. Pat. No. 5,786,057, U.S. Pat. No. 5,843,268, U.S. Pat. No. 5,906,872, U.S. Pat. No. 4,562,651, U.S. Pat. No. 4,837,949, and U.S. Pat. No. 5,024,007.

FIG. 14 is a cross-sectional view of the alternate preferred sole 20.7 shown in FIG. 13, taken along line 14—14, having a generally planar configuration. Again, the preferred protrusions 29 have a width at the tip 32 in the range between 2–4 mm, a height in the range between 3–6 mm, and the closest portion of adjacent protrusions 29 are preferably spaced apart at least 3 mm. Further, the closest portion of adjacent protrusion 29 can be spaced apart in the range between 3–10 mm, and in particular, in the range between 3–6 mm. Accordingly, as shown in FIG. 14, that is, when drawn to 1/1 scale, the protrusions 29 can have a width at the tip 32 of 3 mm, a height of 6 mm, and the closest portions of adjacent protrusions 29 are separated by 6 mm.

FIG. 15 is a cross-sectional view of an alternate preferred sole 20.8 similar to that shown in FIG. 14, taken at position consistent with line 14—14, showing a sole 20.8 having an arcuate or curved configuration generally consistent with the shape of the corresponding portion of a human foot. It can be readily understood that any or all embodiments of a preferred sole 20 taught herein can include arcuate or complex curved configurations generally consistent with the shape of a human foot. As shown in FIG. 15, that is, when drawn to 1/1 scale, the protrusions 29 of sole 20.8 have a conical shape having a width of 4 mm at the base 33, and width of 2 mm at the tip 32. Further, the protrusions 29 of sole 20.8 have a height of 4 mm, and the closest portions of adjacent protrusions 29 are separated by 4 mm.

While the above detailed description of the invention contains many specificities, these should not be construed as limitations on the scope of the invention, but rather as exemplifications of several preferred embodiments thereof. Many other variations are possible. For example, it can be readily understood that the various embodiments and features recited herein can possibly be used in various partial or complete combinations. Accordingly, the scope of the invention should be determined not by the embodiments discussed or illustrated, but by the appended claims and their legal equivalents.

What is claimed is:

1. An article of footwear having an anterior side, a posterior side, a medial side, a lateral side, and a sole comprising a periphery, and a central region, said central region including a ground engaging surface and a plurality of protrusions, the ground engaging surface and the protrusions both comprising a hydrophobic material having a wettability index equal to or greater than 90 degrees, and said periphery comprising a material having a wettability index less than 90 degrees, said protrusions including a tip having a width in the range between 2–4 mm and a height in the range between 3–6 mm, and wherein closest portions of adjacent protrusions are spaced at least 3 mm apart.

2. The article of footwear according to claim 1, wherein the closest portion of said adjacent protrusions are spaced apart in the range between 3–6 mm.

3. The article of footwear according to claim 1, wherein said periphery extends in the range between 4–10 mm from a perimeter of said sole.

4. The article of footwear according to claim 1, wherein said protrusions are annular.

5. The article of footwear according to claim 1, further including at least one line of flexion.

6. The article of footwear according to claim 1, further including a plurality of traction members.

7. The article of footwear according to claim 6, wherein said traction members are positioned relative to a center of rotation in a nautilus configuration.

8. The article of footwear according to claim 6, wherein said traction members comprise a hydrophobic material having a wettability index equal to or greater than 90 degrees.

9. The article of footwear according to claim 6, wherein said traction members include a hydrophilic material having a wettability index less than 90 degrees.

10. The article of footwear according to claim 6, wherein said traction members are softer than said protrusions on a Shore Durometer scale.

11. The article of footwear according to claim 1, wherein said protrusions are positioned relative to a center of rotation in a nautilus configuration.

12. The article of footwear according to claim 1, wherein said medial side and said lateral side of said sole are curved.

13. The article of footwear according to claim 1, wherein said periphery comprises a periphery portion extending between the center portion and an outer perimeter of the sole, and said periphery portion extends in the range between 4–10 mm.

14. The article of footwear according to claim 7, wherein said nautilus configuration is located in the forefoot area.

15. The article of footwear according to claim 7, wherein said nautilus configuration is located in the rearfoot area.

16. An article of footwear having an anterior side, a posterior side, a medial side, and a lateral side, and a sole comprising a periphery, and a central region, said central region including a ground engaging surface and a plurality of spaced protrusions extending from said ground engaging surface with portions of the ground engaging surface between said protrusions, each of said protrusions including a base, a side, and a tip, said plurality of protrusions and the portions of said ground engaging surface between said plurality of protrusions within said central region comprising a hydrophobic material having a wettability index equal to or greater than 90 degrees, and said periphery comprising a material having a wettability index less than 90 degrees, and said tips of said protrusions each have a width in the range between 2–4 mm, and said protrusions having a height in the range between 3–6 mm, and closest portions of adjacent protrusions spaced at least 3 mm apart.

* * * * *